United States Patent [19]

Skolaude et al.

[11] Patent Number: 4,883,518

[45] Date of Patent: Nov. 28, 1989

[54] PROCESS FOR AIR FRACTIONATION BY LOW-TEMPERATURE RECTIFICATION

[75] Inventors: Werner Skolaude, Munich; Gunnar Eggendorfer, Gruenwald; Horst Corduan, Puchheim, all of Fed. Rep. of Germany

[73] Assignee: Linde Akitengesellschaft, Wiesbaden, Fed. Rep. of Germany

[21] Appl. No.: 270,606

[22] Filed: Nov. 14, 1988

[30] Foreign Application Priority Data

Nov. 13, 1987 [DE] Fed. Rep. of Germany ..... 3738559

[51] Int. Cl.[4] ..... F25J 3/00

[52] U.S. Cl. ..... 62/38; 62/43

[58] Field of Search ..... 62/11, 32, 36, 38, 42, 62/43

[56] References Cited

U.S. PATENT DOCUMENTS

| | | | |
|---|---|---|---|
| 4,152,130 | 5/1979 | Theobald | 62/18 |
| 4,555,256 | 11/1985 | Skolaude et al. | 62/38 |
| 4,595,405 | 6/1986 | Agrawal et al. | 62/38 |
| 4,705,548 | 11/1987 | Agrawal et al. | 62/38 |

*Primary Examiner*—Ronald C. Capossela

*Attorney, Agent, or Firm*—Millen, White & Zelano

[57] ABSTRACT

In a system for air fractionation by low-temperature rectification, refrigeration is produced in a cooling stage by compression and expansion of the feed air or of nitrogen from rectification. By using the work gained during expansion for compressing only a partial stream of the gas passed through the cooling stage, the system according to this invention operates with increased efficiency and lower operating costs.

36 Claims, 2 Drawing Sheets

PROCESS FOR AIR FRACTIONATION BY LOW-TEMPERATURE RECTIFICATION

BACKGROUND OF THE INVENTION

The invention relates to a process and associated apparatus for air fractionation by low-temperature rectification wherein the gaseous air stream to be fractionated is conducted through a cooling stage and process cold (refrigeration) is produced by compression and expansion of at least a portion of this gaseous stream. The gaseous air stream is compressed in the cooling stage and thereafter is divided into two partial streams which are at least partially cooled and subjected to engine expansion. The expansion of the first partial stream is performed at a temperature higher than that of the expansion of the second partial stream. Furthermore, both partial streams are compressed prior to expansion, utilizing the work gained during the expansion. In addition, at least a portion of each of the two partial streams is introduced to the rectification step.

Such a process has been described in U.S. Pat. No. 4,152,130. In this reference, the air to be fractionated is introduced, after precompression and prepurification wherein essentially steam and carbon dioxide are separated, into a cooling stage and utilized in the latter as the working gas. In the cooling stage, refrigeration is produced by compression and expansion of this working gas, and the refrigeration obtained is utilized in the process. Within the cooling stage, the second partial stream and a side stream of the first partial stream are subjected to engine expansion. The expansion device used to expand the side stream of the first partial stream operates at a temperature higher than that of the expansion device used to expand the second partial stream. The two expansion processes and the cooling accompanying these steps are performed in parallel to heat exchange with fractionation products in two different temperature ranges. The temperature at the outlet of the expansion device operating at a higher temperature is approximately equal to the temperature at the inlet of the expansion device operating at a lower temperature. By means of the energy obtained in the two expansion devices, both partial streams are compressed in parallel, each respectively compressed by a single compression stage.

This process is not as efficient as that of the present invention.

SUMMARY OF THE INVENTION

An object of one aspect of the invention is to provide an air fractionation process with a cooling stage operating more efficiently, energy-wise, than the above-described conventional process.

An object of another aspect of the invention is to provide the associated apparatus for such a process.

Upon further study of the specification and appended claims, further objects and advantages of this invention will become apparent to those skilled in the art.

These objects are attained according to the invention by performing compression of at least a portion of the second partial stream of the working gas in two compression stages.

The operation of the process according to the invention achieves a high pressure difference between the point where the working gas is divided into the two partial streams and the point of entrance of the second partial stream into the expansion step. Thereby, on the one hand, the pressure difference and thus also the enthalpy difference are high in the expansion device operating at a lower temperature, and, as a consequence, during expansion, a high proportion of the mechanical energy of the highly compressed second partial stream can be obtained as work and reintroduced into the process. Furthermore, a lower than conventional design pressure at the branching or dividing point of the working gas can be utilized, thus lowering the external energy requirements for compression.

The pressure difference between the point at which the working gas is divided and the point of entrance of the second partial stream into the expansion step is generally about 20 to 35 bar, preferably 25 to 35 bar.

In a preferred further development of the process according to the invention, the work gained during expansion of the two partial streams is utilized in the two compression stages for compressing the second partial stream. The thus-gained work herein is returned to the process in the form of mechanical energy.

It proves to be especially advantageous, in a preferred further development of the present invention, to utilize the work gained during expansion of the second partial stream in the first compression stage of the second partial stream.

It is also advantageous to utilize, according to a preferred further development of the process of this invention, the work obtained during expansion of the first partial stream in the second compression stage of the second partial stream.

In an especially preferred further development of the process according to this invention, the first partial stream is engine expanded without compression. The pressure difference between the inlet and the outlet of the expansion device operating at the higher temperature is consequently relatively small, and for this reason, the expansion step can be performed at a high degree of efficiency. Accordingly, a high proportion of the energy released during expansion can be gained as work and reintroduced into the process.

The pressure at the inlet of the expansion device operating at the higher temperature, i.e., the expansion device used in the expansion of at least a portion of the first partial stream, is about 20 to 35 bar, preferably 28 to 32 bar. The outlet pressure of both expansion devices lies between about 5.4–6.6 bar, preferably 5.6–6.0 bar.

The inlet temperature for the expansion device used to expand at least a portion of the first partial stream is generally about 240 to 270K, preferably 250 to 260K. On the other hand, the inlet temperature of the expansion device used to expand at least a portion of the second partial stream is generally about 150 to 180K, preferably 165 to 175K.

The temperature difference between these two inlet temperatures is about 70 to 100, preferably 80 to 90 degrees Kelvin.

It is beneficial in some cases, according to another embodiment of the process according to this invention, to recycle at least a portion of the partial streams, after expansion, into the gaseous stream to be compressed. The amount of recycled gas relative to the amount of air introduced can determine the refrigeration output of the cooling stage. Thus, with the process otherwise remaining the same, a regulatory effect can be imposed by way of the flow in the recycled stream as to which proportion of the end products is produced in the liquid phase and which proportion in the gaseous phase.

Conversely, in another embodiment of the process according to this invention, both partial streams are introduced into the first rectification stage of a twostage rectifying column in their entirety. The expenditure in apparatus can thus be kept at a lower level than in the arrangement which includes a recycle.

In an especially preferred embodiment of the process according to the invention, at least a portion of one or both of the partial streams is cooled by heat exchange with an external coolant. Thereby, in an especially economical way, cold can be introduced additionally from the outside into the process.

It is beneficial, in a further development of the process of this invention, to perform heat exchange with the external coolant to a temperature that is higher than or equal to the temperature at which expansion of the first partial stream begins. Thereby, energy losses during heat exchange, resulting from the temperature difference between the streams in heat exchange being too high, are extensively avoided.

This cold can be introduced in an especially advantageous way if, during heat exchange with the external coolant, the temperature difference between the inlet and outlet is particularly high. The maximum of this difference is essentially the difference between ambient temperature and inlet temperature at the entrance of the expansion device operating at the higher temperature. The latter temperature is particularly low if, according to an above-mentioned feature of the invention, the pressure difference during expansion of the first partial stream is chosen to be small.

The amount of refrigeration which can be transferred to the portion of the partial stream by heat exchange with the external coolant increases as the temperature difference between the inlet and outlet of the heat exchanger increases. The refrigeration provided by the external coolant involves less capital and operating costs than other processes for refrigeration production. Thus, a high temperature difference in this heat exchange step is advantageous for the process as a whole.

In an advantageous further development of the process of this invention, precompressed and prepurified air is utilized as the working gas for the cooling stage. This embodiment proves to be especially advantageous in case a small part of the products, based on the amount of air fractionated, is desired to be obtained in the liquid phase. In this embodiment, the cooling stage comprises the process steps which occur downstream of the precompression and prepurification steps and upstream of the introduction of at least a portion of at least one of the partial streams to the rectification step.

In another advantageous further development of the process according to the invention, nitrogen-enriched gas, withdrawn from the rectification step, is employed as the working gas for the cooling stage. This version of the process is especially expedient in case a relatively large proportion of the products is desired to be withdrawn in the liquid phase. In this embodiment, the cooling stage comprises the process steps downstream of the removal of the nitrogen-enriched work gas from rectification and upstream of the introduction of at least a portion of at least one of the partial streams to the rectification step.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, unless otherwise indicated, all parts and percentages are by weight.

The entire texts of U.S. Pat. No. 4,152,130, cited above, and of German application P 37 38 559.3, filed Nov. 13, 1987 (the priority document), are hereby incorporated by reference.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

Figure 1:
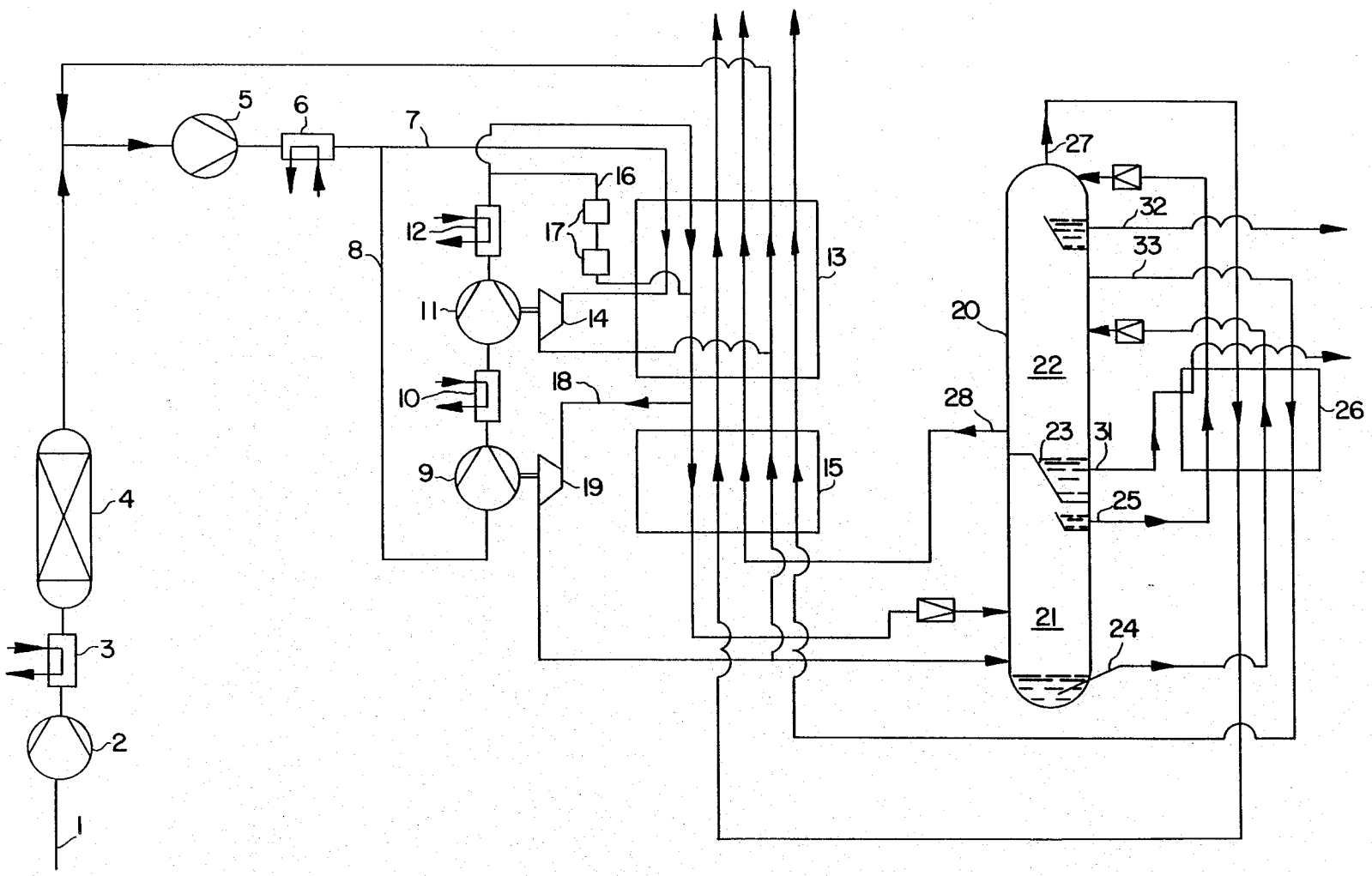
FIG. 1 illustrates an embodiment of the process according to this invention with air as the working gas for the cooling stage.

In the process of FIG. 1, air to be fractionated is introduced at ambient temperature and at atmospheric pressure via a conduit 1 into a compressor 2 wherein the air is compressed to a pressure of about 6–7 bar, preferably 6.4 bar. The thus-compressed air is delivered to a cooler 3 where it is cooled to a temperature that lies 5–10K above the temperature of the cooling water, i.e., in general about ambient temperature, and then delivered to a molecular sieve adsorber 4 in order to separate steam and carbon dioxide therefrom.

Subsequently, the air stream is passed on into the cooling stage and therein compressed in a compressor 5 to a pressure of about 28–32 bar, and cooled in a cooler 6 to almost cooling water temperature. Thereafter, the air stream is divided into a first partial stream 7 and a second partial stream 8.

The second partial stream 8 is compressed in two serial compression stages 9, 11 to about 45–60 bar. In the associated coolers 10, 12, the heat of compression is respectively removed.

The first partial stream 7 is introduced directly into a heat exchanger 13 and therein cooled, countercurrently to fractionation products, to about 230–280K and expanded in an expansion device 14 to about 5.4–6.5 bar. The thus-obtained work is transferred to the second compression stage 11. After expansion, the first partial stream has a temperature of about 150–170K and is recycled, without compression prior to or subsequent to expansion in expansion device 14, to compressor 5 by way of heat exchanger 13.

Downstream of cooler 12, a side stream 16 at cooling water temperature is branched-off from the second partial stream and is cooled, by means of heat exchange with an external coolant, preferably halogenated hydrocarbons, to the temperature of the first partial stream upstream of the expansion device 14, and is recombined in heat exchanger 13 with the remaining second partial stream. Heat exchange with the external coolant is here performed in two stages 17. This cooling step could just as well be performed in one stage. Likewise, a side stream of first partial stream 7, or respectively a side stream of each of the two partial streams 7, 8 could be cooled off by heat exchange with the external coolant.

After further cooling of the entire second partial stream in heat exchanger 13 to about 150–170K, a further partial stream 18 is branched-off from the second partial stream and expanded in expansion device 19 to about 5.6–6.6 bar. The thus-obtained work is passed on to the first compression stage 9. Subsequently, a portion of the expanded side stream 18 is fed into a first stage 21 of a two-stage rectifying column 20 and another portion is recycled into compressor 5 by way of heat exchangers 15 and 13. The residual portion of the second partial stream is throttle-expanded, after further cooling in heat exchanger 15 to a temperature of 95 to 105K, and introduced into the first stage 21 of the rectifying column.

The first stage 21 of the rectification is operated under a pressure of about 5.6–6.6 bar and a temperature of about 95 to 100K. This first stage 21 is in heat exchange relation with a second stage 22, operating under a pressure of about 1.5–1.7 bar and a temperature of about 78 to 94K, by way of a condenser-evaporator 23.

Oxygen-enriched liquid 24 is withdrawn from the bottom of the first stage 21 and nitrogen-enriched liquid 25 is removed from the head of the first stage 21. The two streams 24, 25 are cooled to a temperature of 85 to 90K in a heat exchanger 26 in heat exchange with gaseous nitrogen 27 from the head of the second stage 22 and with residual gas 33, then they are throttle-expanded and introduced into the second stage 22 in correspondence with their composition. The gaseous nitrogen product stream 27 and residual gas stream 33 are heated in heat exchanger 26. Above the bottom of the second stage 22, a gaseous oxygen product stream is removed by way of a conduit 28. The two gaseous product streams 27 and 28 are then conducted, together with the residual gas stream 33, through the heat exchangers 15 and 13 and heated to almost ambient temperature. Product liquid oxygen and product liquid nitrogen are removed from the second stage 22 of the rectifying column via lines 31 and 32, respectively.

The following table lists the compositions of several of the process streams in the embodiment of FIG. 1 (given in vol. %):

| | 7,8 | 24 | 25 | 27 | 28 | 31 | 32 | 33 |
|---|---|---|---|---|---|---|---|---|
| $N_2$ | 78.0 | 58.4–66.8 | 99.9 | 99.9 | — | — | 99.9 | 76.0–99.5 |
| $O_2$ | 21.0 | 32–40 | 1 ppm | 1 ppm | 99.5 | 99.5 | 1 ppm | 0.2–20 |
| Ar | 0.9 | 1.2–16 | 100–400 ppm | 100–400 ppm | 0.5 | 0.5 | 100–400 ppm | |

The process illustrated in FIG. 1 offers an increase in energy efficiency of about 2%, especially when relatively small amounts of gas are compressed in compressor 5, as compared with conventional processes, for example, the process disclosed in U.S. Pat. No. 4,152,130.

Figure 2:
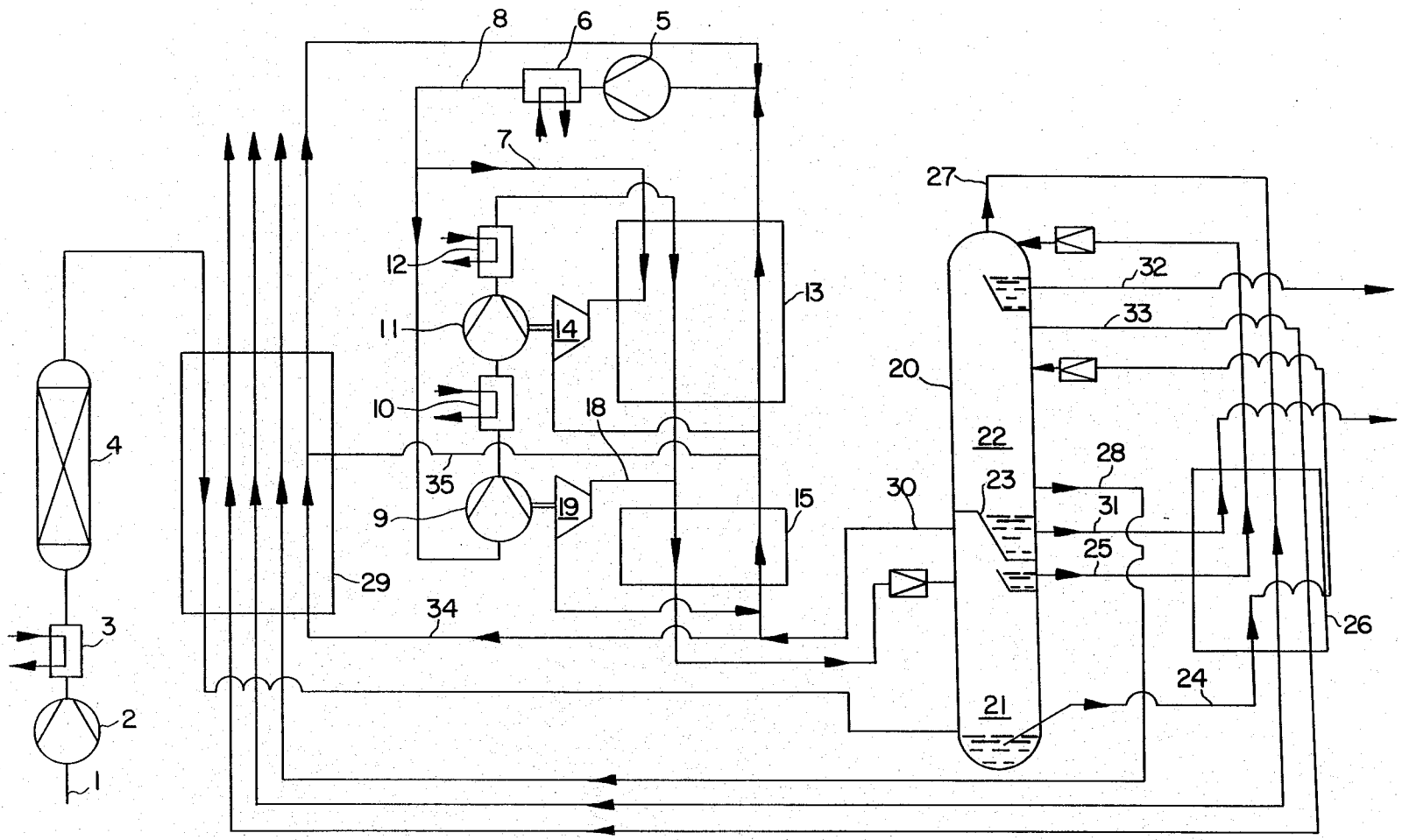
FIG. 2 illustrates another embodiment of the process according to this invention wherein nitrogen-enriched gas from the rectification step serves as the working gas for the cooling stage.

FIG. 2 illustrates, as a further example, a process wherein the cooling stage is operated with nitrogen-enriched gas from the rectifying column as the working gas. This process is very similar to the one illustrated in FIG. 1. The following description relates primarily to the components of the process that are different.

Downstream of the molecular sieve adsorber 4, the precompressed and prepurified air, rather than being introduced into the cooling stage, is cooled, in heat exchange 29 with gaseous fractionation products and a compensating stream 34, to approximately saturation temperature and fed into the first stage 21 of the rectifying column 20. Via conduit 30, nitrogen is withdrawn from the head of the first stage 21 of a temperature of 95 K and introduced as working gas into the cooling stage, the latter having essentially the structure of the cooling stage in FIG. 1.

Prior to entering the compressor 5, the working gas 30 is heated. A portion of working gas 34 is conducted through the heat exchangers 15, 13, and another portion is passed as compensating stream 34 through the heat exchanger 29. A portion of the compensating stream 34 is branched-off in heat exchanger 29 and introduced into heat exchanger 13 via conduit 35. After heating, all branch streams of the working gas are recombined and passed on to compression in compressor 5. The inlet temperature of compressor 5 is 6–8K above cooling water temperature.

In a version deviating from FIG. 1, the entire second partial stream 8 is here introduced, after compression, into heat exchanger 13 without the use of an external coolant for the supply of additional cold. All of the versions, with or without external coolant, can be utilized for both working gases respectively.

Furthermore, as distinguished from the process of FIG. 1, a major portion of the side stream 18 of the second partial stream is recycled, after expansion, into compressor 5.

As the products, liquid oxygen 31 and liquid nitrogen 32 are removed from the second stage of the rectifying column. As in FIG. 1, gaseous product nitrogen and gaseous product oxygen are removed via conduits 27 and 28, respectively.

The following table lists the compositions of several of the process streams in the embodiment of FIG. 2 (given in vol. %):

| | 7,8 | 24 | 25 | 27 | 28 | 31 | 32 | 33 |
|---|---|---|---|---|---|---|---|---|
| $N_2$ | 78.0 | 58.4–66.8 | 99.9 | 99.9 | — | — | 99.9 | 76.0–99.5 |
| $O_2$ | 21.0 | 32–40 | 1 ppm | 1 ppm | 99.5 | 99.5 | 1 ppm | 0.2–20 |
| Ar | 0.9 | 1.2–16 | 100–400 ppm | 100–400 ppm | 0.5 | 0.5 | 100–400 ppm | |

The process illustrated in FIG. 2 offers an increase in energy efficiency of about 1.5-2.5%.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for air fractionation by low-temperature rectification comprising a rectification step from which nitrogen and product oxygen streams are obtained and a cooling stage wherein a process gas of the air fractionation is employed as working gas to produce refrigeration by compression and expansion of at least a portion of said working gas, the improvement comprising:

compressing said working gas in said cooling stage and thereafter dividing said working gas into a first partial stream and a second partial stream, both of which are at least partially cooled and at least partially subjected to engine expansion, said first partial stream being expanded at a temperature higher than that at which the second partial stream is expanded;

compressing at least said second partial stream, prior to expansion, wherein work gained during expansion of at least a part of one of said partial streams is utilized in the compression of said second partial stream, said compression of said second partial stream being performed in two compression stages; and introducing at least a portion of at least one of said partial streams to the rectification step.

2. A process according to claim 1, wherein work gained during expansion of both partial streams is utilized in said two compression stages for compression of said second partial stream.

3. A process according to claim 2, wherein work gained during expansion of said second partial stream is utilized in a first compression stage of said two compression stages for compression of said second partial stream.

4. A process according to claim 3, wherein work gained during expansion of said first partial stream is utilized in a second stage of said two compression stages for compression of said second partial stream.

5. A process according to claim 1, wherein work gained during expansion of said second partial stream is utilized in a first compression stage of said two compression stages for compression of said second partial stream.

6. A process according to claim 5, wherein work gained during expansion of said first partial stream is utilized in a second stage of said two compression stages for compression of said second partial stream.

7. A process according to claim 1, wherein work gained during expansion of said first partial stream is utilized in a second stage of said two compression stages for compression of said second partial stream.

8. A process according to claim 1, wherein said first partial stream is engine expanded without subsequent or prior compression.

9. A process according to claim 1, wherein a portion of at least one of said partial streams is recycled, after expansion, to said working gas to a point upstream of the compression of said working gas.

10. A process according to claim 9, wherein a portion of each of said partial streams is recycled, after expansion, to said working gas to a point upstream of the compression of said working gas.

11. A process according to claim 9, wherein the entirety of said first partial stream is recycled to said working gas to a point upstream of the compression of said working gas.

12. A process according to claim 1, wherein both partial streams are fed in their entirety to the rectification.

13. A process according to claim 1, further comprising, prior to the introduction of air to the air fractionation process, compressing the air to be fractionated and purifying the air to be fractionated by removal of steam and carbon dioxide.

14. A process according to claim 13, wherein after purification of said air to be fractionated, the air to be fractionated is cooled and then delivered directly to a high pressure stage of a two-stage rectification.

15. A process according to claim 14, wherein said working gas is a nitrogen-enriched gas removed from said rectification step.

16. A process according to claim 13, wherein said working gas is the air to be fractionated.

17. A process according to claim 16, wherein after prepurification of said air to be fractionated, the air is delivered directly to said cooling stage.

18. A process according to claim 1, wherein said working gas is the air to be fractionated.

19. A process according to claim 18, wherein said rectification step comprises a rectification column having a first high pressure stage and a second low pressure stage, said first and second stages of said rectification column being in heat exchange relation by a condenser-evaporator.

20. A process according to claim 19, wherein gaseous product nitrogen is removed from the head of said second stage or said rectification column, gaseous product oxygen is removed from a lower portion of said second stage of said rectification column, product liquid nitrogen is removed from an upper portion of said second stage of said rectification column, and product liquid oxygen is removed from the bottom of said second stage of said rectification column.

21. A process according to claim 18, wherein at least a portion of at least one of said partial streams is subjected to cooling by external coolant in said cooling stage.

22. A process according to claim 21, wherein a portion of said second partial stream is subjected to cooling by external coolant in said cooling stage prior to expansion of said second partial stream.

23. A process according to claim 21, wherein said at least a portion of at least one of said partial streams is cooled by external coolant to a temperature which is higher than or equal to the inlet temperature of the expansion device employed in the expansion of at least a portion of said first partial stream.

24. A process according to claim 1, wherein said working gas is a nitrogen-enriched gas removed from said rectification step.

25. A process according to claim 24, wherein at least a portion of said nitrogen-enriched gas employed as said work gas is heated by heat exchange with said partial streams prior to compression of said working gas.

26. A process according to claim 25, wherein a side stream of said nitrogen-enriched gas is heated by heat exchange with the air to be fractionated prior to compression of said working gas.

27. A process according to claim 26, wherein a portion of said second partial stream, which is not subjected to expansion in an expansion device from which work is gained, is delivered to a high pressure stage of a two-stage rectification.

28. A process according to claim 25, wherein said rectification step comprises a rectification column having a first high pressure stage and a second low pressure stage, said first and second stages of said rectification column being in heat exchange relation by a condenser-evaporator.

29. A process according to claim 28, wherein said nitrogen-enriched gas is removed from the head of said high pressure stage of said rectification column.

30. A process according to claim 24, wherein at least a portion of at least one of said partial streams is subjected to cooling by external coolant in said cooling stage.

31. A process according to claim 30, wherein said at least a portion of at least one of said partial streams is cooled by external coolant to a temperature which is higher than or equal to the inlet temperature of the expansion device employed in the expansion of at least a portion of said first partial stream.

32. A process according to claim 1, wherein said rectification step comprises a rectification column having a first high pressure stage and a second low pressure stage, said first and second stages of said rectification column being in heat exchange relation by a condenser-evaporator.

33. A process according to claim 32, wherein gaseous product nitrogen is removed from the head of said second stage or said rectification column, gaseous product oxygen is removed from a lower portion of said second stage of said rectification column, product liquid nitrogen is removed from an upper portion of said second stage of said rectification column, and product liquid oxygen is removed from the bottom of said second stage of said rectification column.

34. A process according to claim 1, wherein at least a portion of at least one of said partial streams is subjected to cooling by external coolant in said cooling stage.

35. An apparatus for air fractionation by low-temperature rectification comprising:

(a) compression means for compressing the air to be fractionated;

(b) means for dividing resultant compressed air into a first partial stream and a second partial stream;

(c) heat exchange means for cooling said first partial stream;

(d) expansion means for expanding the cooled first partial stream to remove mechanical energy therefrom;

(e) recycle means for recycling the expanded first partial stream to a point upstream of said compression means (a);

(f) two serially connected compression stages for compressing said second partial stream;

(g) heat exchange means for cooling resultant compressed second partial stream;

(h) expansion means for expanding at least a portion of said second partial stream to remove mechanical energy therefrom;

(i) a two-stage rectification column comprising a first high-pressure stage and a second low-pressure stage, said first stage and said second stage being in heat exchange relation by a condenser-evaporator;

(j) delivery means for delivering said second partial stream to said first stage of said rectification column; and (k) product delivery means for removing gaseous and liquid product nitrogen and gaseous and liquid product oxygen from said second pressure stage of said rectification column;

wherein said two serially connected compression stages are in connection with expansion means (d) and (h) whereby mechanical energy obtained in said expansion means (d) and (h) is utilized to operate said two serially connected compression stages.

36. An apparatus for air fractionation by low-temperature rectification comprising:

(a) heat exchange means for cooling air to be fractionated;

(b) a two-stage rectification column comprising a first high-pressure stage and a second low-pressure stage, said first stage and said second stage being in heat exchange relation by a condenser-evaporator, said first stage having an inlet means for delivery of cooled air to be fractionated, said second stage having product delivery means for removal of gaseous and liquid product nitrogen and gaseous and liquid product oxygen therefrom;

(c) outlet means for removing nitrogen-enriched gas from an upper portion of said first stage of said rectification column;

(d) compression means in fluid communication with said outlet means (c) for compressing said nitrogen-enriched gas;

(e) means for dividing the compressed nitrogen-enriched gas into a first partial stream and a second partial stream;

(f) cooling means for cooling said first partial stream;

(g) expansion means for expanding said first partial stream to remove mechanical energy therefrom;

(h) recycle means for recycling the expanded first partial stream to a point upstream of said compression means (d);

(i) two serially connected compressed stages for compressing said second partial stream;

(j) cooling means for cooling the compressed second partial stream;

(k) expansion means for expanding at least a portion of said second partial stream to remove mechanical energy therefrom; and (l) delivery means for delivering at least a portion of said second partial stream to said first high-pressure stage of said rectification column;

wherein said two serially connected compression stages are in connection with expansion means (g) and (k) whereby mechanical energy obtained in said expansion means (g) and (k) is utilized to operate said two serially connected compression stages.

* * * * *